United States Patent [19]

Girona

[11] Patent Number: 4,865,053

[45] Date of Patent: Sep. 12, 1989

[54] HABIT CONTROL: CIGARETTE AND CIGAR SAVER

[76] Inventor: Alfonso S. Girona, P.O. Box 3203, San Juan, P.R. 00936

[21] Appl. No.: 319,117

[22] Filed: Nov. 9, 1981

[51] Int. Cl.[4] ..... A24D 3/00

[52] U.S. Cl. ..... 131/175; 131/331; 131/256

[58] Field of Search ..... 131/349, 175, 256, 175, 131/331, 343

[56] References Cited

U.S. PATENT DOCUMENTS

| | | | |
|---|---|---|---|
| 1,770,616 | 7/1930 | Kean | 131/349 |
| 1,923,242 | 8/1933 | Udine | 131/175 |
| 2,134,213 | 10/1938 | Skidmore | 131/349 |
| 2,440,882 | 5/1948 | Walton | 131/175 |
| 3,094,450 | 6/1963 | Davidson | 131/331 |
| 3,165,105 | 1/1965 | Campbell | 131/349 |
| 3,916,916 | 11/1975 | Bramucki | 131/175 |

*Primary Examiner*—V. Millin

*Attorney, Agent, or Firm*—Berman, Aisenberg & Platt

[57] ABSTRACT

A combination holder and cover for a substantially cylindrical wrapped smoking material whereby a lit tobacco product is placed in said holder and inserted into said cover until said holder and cover fit snugly, thereby extinguishing the lit tobacco product and providing a means for storing and protecting the tobacco product for resmoking or disposal. Alternatively, the holder is in the form of a mouthpiece through which the tobacco product can be smoked.

14 Claims, 2 Drawing Sheets

FIG. 1
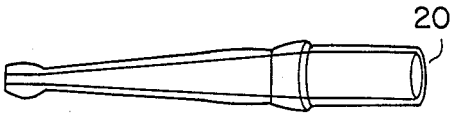
FIG. 2
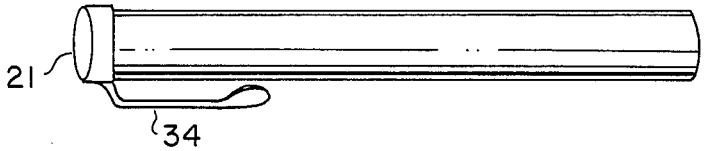
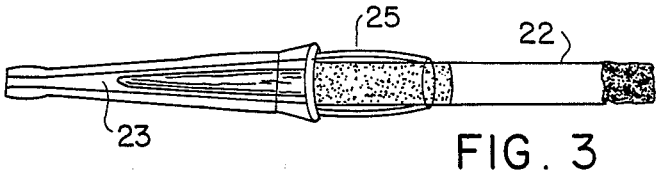
FIG. 3
FIG. 4
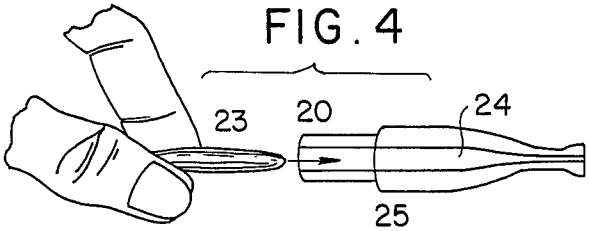
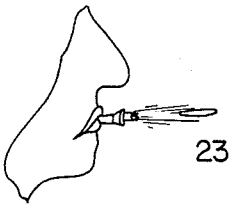
FIG. 5
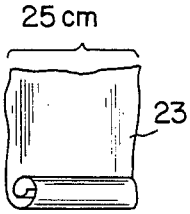
FIG. 6

HABIT CONTROL: CIGARETTE AND CIGAR SAVER

BACKGROUND OF THE INVENTION

1. Field of the Invention

The invention relates to tobacco products, such as cigarettes and cigars, and to ashtrays and extinguishers applicable thereto.

2. Description of the Prior Art

Smokers usually extinguish and dispose of lighted tobacco products by means of ashtrays. In some instances, smokers do not have a convenient ashtray or means for extinguishing a lighted tobacco product, e.g. a cigarette or cigar, which can result in littering and environmental damage. Moreover, laws now prohibit smoking in some public places, for example restaurants and elevators; a smoker may thus be required to extinguish a tobacco product and to dispose of it when appropriate facilities are not available.

Further, smokers who do not wish to (or cannot) finish smoking their entire tobacco product, once lit, are occasionally forced to throw away the remaining portion, since the usual means of extinguishing it involve either crushing the lighted end, soaking the lighted end in water or letting the product burn out, which usually destroys the wrapper of the tobacco product. Additionally, even if tobacco products could be extinguished without damage, the problem of conveniently storing and protecting the unsmoked portion would remain.

SUMMARY OF THE INVENTION

An object of the invention is to provide smokers with a convenient means of extinguishing, storing and protecting a lighted tobacco product either for resmoking at a later date or for disposal. The invention, accordingly, prevents littering, environmental damage and inconveniencing of non-smokers, it also facilitates compliance with laws regarding prohibition against smoking in public places. Moreover, the invention, by storing and protecting a partially-smoked tobacco product, prevents waste and keeps the freshness, flavor, taste, and fragrance of the tobacco product.

A further object of this invention is to help smokers reduce the total number of tobacco products consumed. Smokers who feel compelled to smoke an entire tobacco product in order to prevent the waste of the unsmoked portion are encouraged by this invention to stop smoking at any time, since the remaining portion may be extinguished, stored and protected for later use.

The invention is embodied in a combination of a holder and a cover for substantially-cylindrical wrapped smoking material wherein:

the holder has (a) a cylindrical sleeve (at one end) which is adapted to fit sufficiently snugly over a minor portion of the wrapped smoking material to hold said smoking material fairly securely and (b) a ridge around and fixed with respect to the outside of the cylindrical sleeve and remote from the one end of the holder, and the cover is an air-impermeable or imperforate, substantially noncombustible hollow cylinder, one end of which is closed and the other end of which is adapted to fit snugly over the cylindrical sleeve and to abut against the ridge.

According to the invention, a smoking tobacco product, e.g. a cigar or cigarette, may be extinguished by placing the mouthpiece of the tobacco product into a holder (having a closed end and a tubular extension end) with a cavity for encasing the mouthpiece portion of the tobacco product. The lit portion of the tobacco product is then inserted into an air-impermeable noncombustible cover (closed at one end) until the extension end of the holder fits tightly in the opening of the cover. The tobacco product is thereafter quickly extinguished and may then be safely carried by attaching the holder to one's shirt pocket by means of a clip. The unsmoked portion of the tobacco product may thereafter be either smoked or properly disposed of.

BRIEF DESCRIPTION OF THE DRAWINGS

The preceding and other objects, features and advantages of the invention will be clear from the following description of the invention and from the appended claims, taken in conjunction with the accompanying drawings which show, by way of example, several preferred embodiments of the invention and wherein:

FIG. 1 is a perspective view showing a cigarette holder.

FIG. 2 is a tubular, cylindrical sleeve, closed at one end, with a shirt pocket clip attached thereto.

FIG. 3 is a perspective view showing the holder identified in FIG. 1 with a cigarette inserted therein.

FIG. 4 illustrates the manner in which a filter is inserted in the cigarette holder.

FIG. 5 illustrates one way of removing a used filter from the cigarette holder.

FIG. 6 illustrates one way of preparing a suitable filter.

PARTICULAR DESCRIPTION OF THE INVENTION

Figure 7:
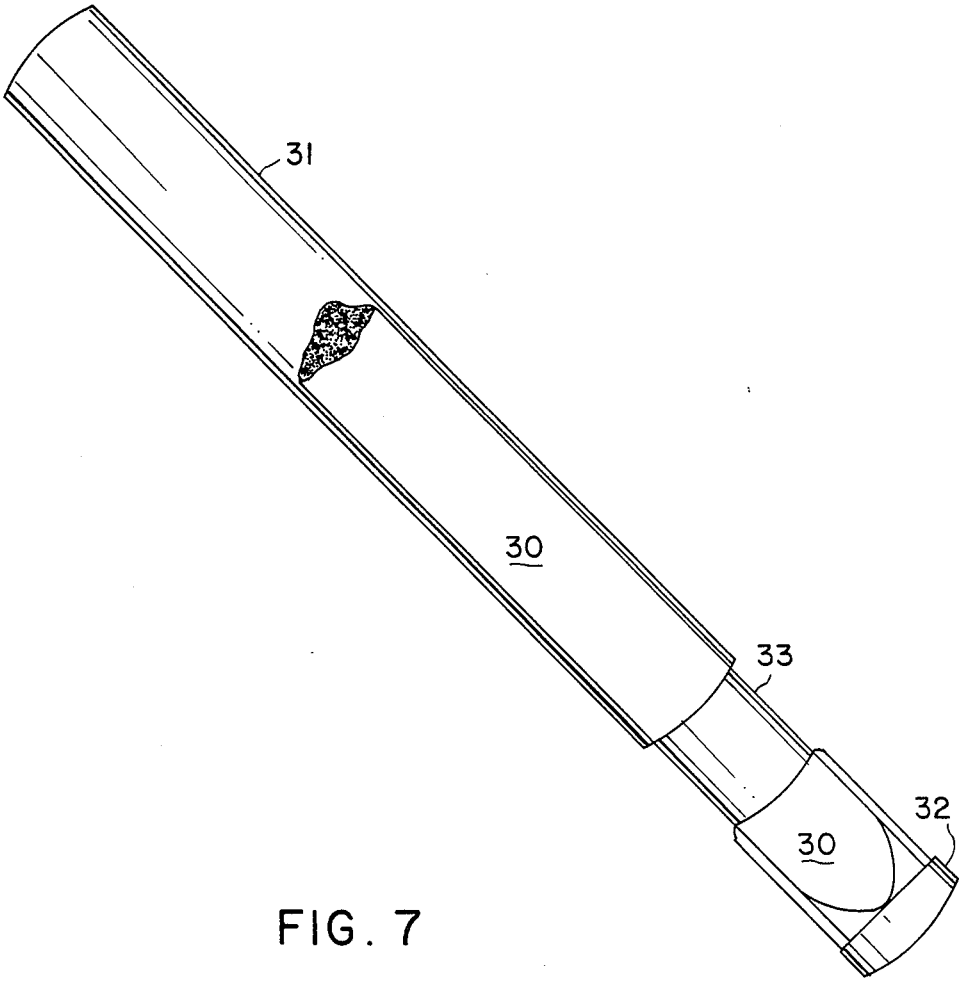
FIG. 7 shows a holder and cover for a cigar.

Referring to FIGS. 1 and 2, the invention comprises the combination of a cigarette holder (1) and a cover (7). The cigarette holder (1) being hollow and having a cylindrical sleeve (4), a non-heat conducting mouthpiece (2) and a flange or ridge (3) therebetween. Said flange (3) being of greater diameter than the outer circumference of the open end (5) of the cover. The cylindrical sleeve (4) of the holder (1) having an inner circumference of sufficient diameter so as to hold a cigarette (10) of conventional size firmly (FIG. 3). The outer circumference of said cylindrical sleeve (4) having a diameter sufficient to fit snugly within the inner circumference of the open end (5) of the cover (7).

The cover (7) having a sufficient size to contain a conventional cigarette (10). A clip (6) is attached by means known in the art to the cover so that the cover may be secured to one's pants or shirt pocket.

An alternative embodiment of the cigarette holder is set forth in FIG. 3, wherein the hollow space in the cigarette holder is of sufficient size to contain a filter (9).

The cover (7) and cylindrical sleeve (4) of the holder (1) are made of a non-combustible material, such as aluminum or a heat-resistant plastic. The cover and holder are preferably made by extrusion.

In operation, a tissue paper (e.g. toilet paper) filter (9) is first rolled (FIG. 6) and inserted into the cylindrical sleeve (4) of the holder (1) (FIG. 4). The unlit end of a cigarette is then inserted into the cylindrical sleeve (4) until firmly secured. The cigarette (10) is then lit and smoked through mouthpiece (2). To extinguish the cigarette, the lit end of the cigarette is inserted first into the open end (5) of the cover (7) until the cylindrical sleeve (4) holding the cigarette (10), fits tightly therein, thereby reducing the air-supply to the cigarette and extinguishing it. The holder containing the cigarette may then be clipped to one's pocket for safekeeping. When convenient, the holder may be withdrawn from the cover (7) and the cigarette (10) resmoked, or the cigarette may be removed from the cylindrical sleeve and disposed of.

Referring to FIG. 5, once the cigarette (10) is removed, the filter (9) contained in the holder may be expelled by blowing air through the mouthpiece (1) toward the cylindrical sleeve (4).

An alternative embodiment of the invention is set forth in FIG. 7 wherein the cover (11) is of sufficient size to contain a cigar (12) and wherein the holder (13) for the cigar is closed at one end (14).

In operation, the unlit end of the cigar (15) is secured firmly in the cylindrical sleeve (16) of the holder (13). The lit end of the cigar (17) is then inserted first into open end of the cover (18) until the cylindrical sleeve (16) and cover (11) fit snugly, resulting in extinguishing of the cigar. The holder (13) may later be withdrawn from the cover (11) and the cigar (12) detached from the holder (13) for resmoking or disposal.

On occasions when ash traps are unavailable, the covers (7 and 11) are convenient substitutes therefore and thus permit ash disposal without littering.

I claim:

1. A combination of a holder and a cover for substantially cylindrical wrapped smoking material wherein the holder has (a) at one end, a cylindrical sleeve which is adapted to fit sufficiently snugly over a minor portion of the wrapped smoking material to hold said smoking material fairly securely and (b) a ridge around and fixed with respect to the outside of the cylindrical sleeve and remote from the one end of the holder, and the cover is an air-impermeable or imperforate, removable, substantially noncombustible hollow cylinder, one end of which is closed and the other end of which is adapted to fit snugly over the cylindrical sleeve and to abut against the ridge, so as to create a substantially air-tight seal within said cylindrical sleeve.

2. A combination according to claim 1 wherein the holder is hollow and has a tip which is suitable as a mouthpiece for smoking when the wrapped smoking material is secured in the cylindrical sleeve, the tip and the cylindrical sleeve being at opposite ends of said holder.

3. A combination according to claim 2 wherein the holder is adapted to receive a filter in a portion thereof which is more remote from the one end than the ridge around the cylindrical sleeve.

4. A combination according to claim 3 wherein a filter is in the holder in a portion thereof which is more remote from the one end than the ridge around the cylindrical sleeve.

5. A combination according to claim 1 having a pocket clip on the outside and near one end of the cover.

6. A combination according to claim 1 wherein wrapped smoking material is secured within the cylindrical sleeve.

7. A combination according to claim 6 wherein the wrapped smoking material is partially smoked.

8. A combination according to claim 6 wherein the wrapped smoking material is a cigarette.

9. A combination according to claim 6 wherein the wrapped smoking material is a cigar.

10. A combination of (a) a hollow elongate holder having a mouthpiece and a cylindrical sleeve at opposite ends and (b) a removable cover for a substantially cylindrical wrapped smoking material having one end which is closed and another open end which is adapted to fit snugly over the cylindrical sleeve so as to create a substantially air-tight seal with said cylindrical sleeve, wherein the cylindrical sleeve is adapted to fit sufficiently snugly over a minor portion of the wrapped smoking material to hold said smoking material fairly securely and the holder has means adjacent the cylindrical sleeve and remote from the end, for preventing the insertion of the cylindrical sleeve into said cover beyond a certain distance.

11. A combination according to claim 10 wherein said means for preventing insertion of the cylindrical sleeve into said cover beyond a certain distance is a flange around the outside of the cylindrical sleeve.

12. A combination according to claim 11 wherein the holder is adapted to receive a filter in the hollow portion thereof.

13. A combination according to claim 12 having a filter inserted in that portion of the holder adapted to receive said filter.

14. A combination according to claim 13 wherein said filter is made of tissue paper.

* * * * *